US007118449B1

(12) United States Patent
Dinger et al.

(10) Patent No.: US 7,118,449 B1
(45) Date of Patent: Oct. 10, 2006

(54) METHOD OF MANUFACTURING AN OPTICAL ELEMENT

(75) Inventors: Udo Dinger, Oberkochen (DE); Frank Eisert, Aalen (DE); Siegfried Stacklies, Abtsgmuend (DE); Martin Weiser, Sinsheim (DE); Guenther Seitz, Spiegelberg (DE)

(73) Assignee: Carl Zeiss SMT AG, Oberkochen (DE)

( * ) Notice: Subject to any disclaimer, the term of this patent is extended or adjusted under 35 U.S.C. 154(b) by 109 days.

(21) Appl. No.: 10/943,952

(22) Filed: Sep. 20, 2004

(51) Int. Cl.
*B24B 49/00* (2006.01)
*B24B 51/00* (2006.01)
*B24B 1/00* (2006.01)

(52) U.S. Cl. ..... 451/6; 451/8; 451/42; 451/43; 451/54; 451/57

(58) Field of Classification Search ..... 351/159, 351/177; 451/6, 8, 36, 42, 43, 54, 55, 57, 451/58, 59, 61, 63
See application file for complete search history.

(56) References Cited

U.S. PATENT DOCUMENTS

| | | | | |
|---|---|---|---|---|
| 2,510,113 | A * | 6/1950 | Holman et al. | 451/180 |
| 3,816,997 | A * | 6/1974 | Rupp | 451/277 |
| 5,720,649 | A * | 2/1998 | Gerber et al. | 451/41 |
| 6,227,952 | B1 * | 5/2001 | Diehl et al. | 451/140 |
| 7,004,821 | B1 * | 2/2006 | Guillermin et al. | 451/43 |
| 2005/0225774 | A1 * | 10/2005 | Freimann et al. | 356/515 |

FOREIGN PATENT DOCUMENTS

| | | | |
|---|---|---|---|
| DE | 101 27 086 | A1 | 12/2002 |
| WO | 02/099818 | A1 | 12/2002 |

OTHER PUBLICATIONS

A. Offner et al., *Null Tests Using Compensators*, Optical Shop Testing, Second Edition, 1992, Chapter 12, pp. 426-454, John Wiley & Sons, Inc., New York.
Norman J. Brown, *Preparation of Ultrasmooth Surfaces*, Ann. Rev. Mater. Sci, 1986, vol. 16, pp. 371-388.
Silvia M. Booij et al., *Jules Verne—a new polishing technique related to FJP*, Proceedings of SPIE vol. 5180, Optical Manufacturing and Testing V. Ed. H. Philip Stahl, Dec. 2003, pp. 89-100, International Society for Optical Engineering (SPIE), Bellingham, Washington.
Lynn N. Allen et al., *Demonstration of an ion figuring process*, SPIE vol. 1333, Advanced Optical Manufacturing and Testing, 1990, pp. 22-33, International Society for Optical Engineering (SPIE), Bellingham, Washington.

* cited by examiner

*Primary Examiner*—Timothy V. Eley
(74) *Attorney, Agent, or Firm*—Jones Day

(57) ABSTRACT

A method of manufacturing an optical element having an optical surface extending close to a periphery of a substrate comprises: providing a substrate having a main surface extending beyond a periphery of the optical surface and also performing a polishing of the optical surface in regions of the main surface extending beyond the optical surface. Thereafter, material of the substrate carrying a portion of the surface extending beyond the optical surface is removed.

19 Claims, 4 Drawing Sheets

METHOD OF MANUFACTURING AN OPTICAL ELEMENT

BACKGROUND OF THE INVENTION

1. Field of the Invention

The present invention relates to a method of manufacturing an optical element having an optical surface of a predetermined shape. In particular, the manufactured optical element has an optical surface of a predetermined shape extending close to a periphery of a substrate on which the optical surface of the predetermined shape is formed. In particular the invention also relates to the manufacture of an optical element having an optical surface of an aspherical shape.

2. Brief Description of Related Art

An optical element having an optical surface can be, for example, an optical component such as an optical mirror or an optical lens, used in an optical system, such as a telescope used in astronomy, or an optical system used for imaging structures of a mask, such as a reticle, onto a radiation sensitive substrate, such as a resist, in a lithographic process. The success of such an optical system is substantially determined by the accuracy with which the optical surface of its components can be machined or manufactured to have a designed target shape.

A conventional method of manufacturing an optical element comprises processing of the optical surface such that differences between a shape of the optical surface and a target shape thereof are within given tolerances. The tolerances depend on the application for which the optical surface is designed and can be chosen by one of ordinary skill in the art based upon a desired application. Typically, tolerances are lower for applications using shorter wavelengths of the light used in the imaging application. Further, different tolerances can be defined for different spatial length scales over which surface variations occur. Such spatial length scales are also referred to as spatial wavelengths or spatial wavelength ranges. For example, different tolerances can be defined as rms values of a distribution of the differences between the surface shape and its target shape in a lateral direction of the surface for different spatial wavelengths. For example, a first tolerance is defined for differences in a low spatial wavelength range (LSFR) in the order of about millimeters to some 10 centimeters, which corresponds to dimensions in the order of about one tenth of a diameter of the optical surface up to the diameter of the optical surface. Such tolerances typically represent a shape error of the optical surface. Shape errors of the optical surface contribute to aberrations of an optical system in which the optical surface is used.

Processing for reducing deviations in the low spatial wavelength range typically include milling, grinding, fine grinding, such as loose abrasive grinding, polishing and others. Methods of measuring deviations or surface errors of this spatial wavelength range typically include interferometric measuring methods using measuring beams of light having a diameter corresponding to the diameter of the optical surface or less, if a stitching method is used in which measuring results of portions of the optical surface are stitched together to achieve a measuring result indicative for the surface shape of the whole surface.

Polishing tools which are in contact with the optical surface at comparatively large contact surfaces are typically used to reduce deviations in a medium spatial wavelength range (MSFR) of the order of about millimeters down to about micrometers, and in a high spatial wavelength range (HSFR) in the order of about micrometers down to about the wavelength of the light used in the application. Tolerances defined for the medium spatial wavelength range and the high spatial wavelength range typically represent a surface roughness of the optical surface. Surface deviations in the medium spatial wavelength range may contribute to a stray light or flare within an optical field of the optical system in which the optical surface is used. Surface deviations in the high spatial wavelength range may contribute to a reduction of reflectivity of the optical surface if used as a mirror in an optical system.

For polishing an optical surface in a region of a periphery thereof, it is necessary that the main surface of the substrate on which the optical surface is formed extends beyond the periphery of the optical surface such that the polishing tool can reciprocate in the region of the periphery of the optical surface while maintaining a steady and continuous pressure towards the optical surface. If a peripheral region of the main surface surrounding the optical surface were not provided, there would be a risk of deteriorating the global shape of the optical surface, i.e. of increasing deviations in the low spatial wavelength range and possibly also even in the mid spatial wavelength range, in a region close to the periphery of the optical surface by polishing.

The peripheral surfaces surrounding the optical surface of the optical element are often used as contact surfaces for mounting the optical element in suitable mounts. In some applications however, it is desirable that the optical surface of the predetermined shape extends close to the periphery of the substrate. An example of such an application is a mirror used in a projection optical system for imaging structures of a radiation sensitive substrate in a lithographic process using extreme ultraviolet (EUV) radiation. In this application, the optical element is a mirror disposed in a folded beam path, and a substrate of the mirror extending beyond the mirror surface would obscure portions of the beam path.

SUMMARY OF THE INVENTION

The present invention has been accomplished taking the problems outlined above into consideration.

Thus, it is an object of the present invention to provide an improved method of manufacturing an optical surface of a high quality and extending close to a periphery of a substrate on which the optical surface is formed.

The forgoing objects are accomplished by providing a method of manufacturing an optical element having an optical surface of a predetermined shape by machining a substrate having a main surface extending beyond an outline of the optical surface of the main surface. The substrate is machined such that it has a higher thickness in an interior of the outline of the optical surface, and a reduced thickness in a removable portion of the main surface disposed outside of the outline of the optical surface. Thereafter the main surface is processed by methods such as milling, grinding, fine grinding and polishing to obtain a surface shape of the main surface within the outline of the optical surface which closely corresponds to a target shape of the optical surface. In particular, the main surface is processed such that differences between the shape of the main surface and the predetermined shape are, within the outline of the optical surface, below a predetermined first tolerance. Such first tolerance may represent a shape error of the optical surface and selection of a value of such tolerance can be made by the person of ordinary skill in the art depending on the particular application. In particular, the first tolerance may be defined as a predetermined rms value of the differences between an actual shape and the predetermined (target) shape at a spatial wavelength in a spatial wavelength range between 1 mm and about a diameter of the optical surface. Examples of that value are 20 nm rms and lower values, such as 10 nm rms, 5 nm rms or 1 nm rms.

The main surface is then further processed by a method, such as polishing, such that differences between the shape of the main surface and the predetermined shape are, within the outline of the optical surface, below a predetermined second tolerance of 1 nm rms in a spatial wavelength range from about 100 nm to about 1 mm. Such processing may be understood as a processing of the optical surface to reduce a surface roughness thereof to below a predefined value.

Thereafter, the removable portion of the substrate is removed to reduce the distance between a periphery of the optical surface and a periphery of the main surface of the substrate.

The inventors have found that the method illustrated above is advantageous in manufacturing a high quality optical surface extending close to a periphery of a substrate on which it is formed, based on the following considerations:

It is conceivable to start the processing of the optical surface from a substrate having a same thickness both within the outline of the optical surface and outside thereof, to polish the optical surface to obtain the desired low surface roughness, and to remove the removable portion thereafter. The removal of the removable portion of the substrate may, however, release internal stress stored within the substrate such that deformations of the remaining substrate will occur, resulting in deformations of the polished optical surface which was previously manufactured. The same holds for deformations due to a change in gravitational loads. Such deviations will be in the lower and mid spatial wavelength ranges, and reducing these deviations is difficult since methods such as corrective processing with small tools will increase the surface roughness in the medium and high spatial wavelength ranges, and subsequent polishing may again cause deviations in the low spatial wavelength range in those regions of the optical surface which are close to the periphery of the substrate where the removable portion has been removed, since a peripheral portion of the main surface extending beyond the optical surface is no longer available at those regions for supporting the polishing tool.

According to the present invention a substantial portion of the substrate outside of the outline of the optical surface is removed before the processing and polishing of the optical surface is performed. This will already release a considerable portion of the stored internal stress of the substrate before manufacturing and polishing the optical surface is performed. Additionally, changes in gravitational loads will be minimized. However, a membrane of a reduced thickness is maintained in that portion for providing a peripheral portion of the main surface extending beyond the optical surface for supporting the polishing tool. The removal of the membrane of a reduced thickness after polishing the optical surface will release only comparatively low internal stresses such that a high deterioration of the optical surface is avoided.

According to an exemplary embodiment of the invention a further processing of the main surface is performed after removal of the membrane portion for reducing remaining deviations between the shape of the optical surface and its target shape. Preferably, such processing uses methods which are suitable to reduce deviations in the low and possibly mid spatial wavelength ranges, while maintaining acceptable deviations in the medium and high spatial wavelength ranges. Such methods may include ion beam figuring, magneto-rheological finishing and fluid jet polishing.

According to a further exemplary embodiment, the removing of the removable portion includes forming a beveled edge comprising an inclined surface extending under a bevel angle with respect to the main surface and adjacent thereto, and thereafter removing substrate material to reduce a width of the inclined surface.

According to a further exemplary embodiment, the removing of the removable portion comprises etching and/or polishing of a lateral surface of the substrate, generated by removing the removable portion. The etching and polishing may have an advantageous effect of releasing internal stress and subsurface damage introduced by the excess material removal in a region close to a periphery of the optical surface.

According to a further exemplary embodiment, the predetermined shape is an aspheric shape. The inventive method is particularly suitable for manufacturing aspherical optical surfaces of high quality and extending close to the periphery of the substrate, particularly since polishing of aspherical surfaces may deteriorate the surface shape of the aspherical surface in regions close to the periphery thereof if a peripheral portion of the main surface outside the optical surface is not provided. Within the context of the present application, an optical surface may be regarded as an aspherical surface, if a difference between the aspherical surface target shape and a best approximating sphere exceeds 200 nm.

According to a further exemplary embodiment, the method further comprises finishing of the optical surface. Finishing may include applying a coating to the optical surface, such as a reflective coating, an anti-reflective coating and a protective coating.

Generally, in the sense of the present application, processing includes changing a structure of the processed surface by methods using a machine tool having a drive, such as a motor, and by methods involving direct hand work using a suitable tool, such as a cloth or fabric.

BRIEF DESCRIPTION OF THE DRAWINGS

The forgoing, as well as other advantageous features of the invention will be more apparent from the following detailed description of exemplary embodiments of the invention with reference to the accompanying drawings. It is noted that not all possible embodiments of the present invention necessarily exhibit each and every, or any, of the advantages described herein.

DETAILED DESCRIPTION OF THE EXEMPLARY EMBODIMENTS

Figure 2A:
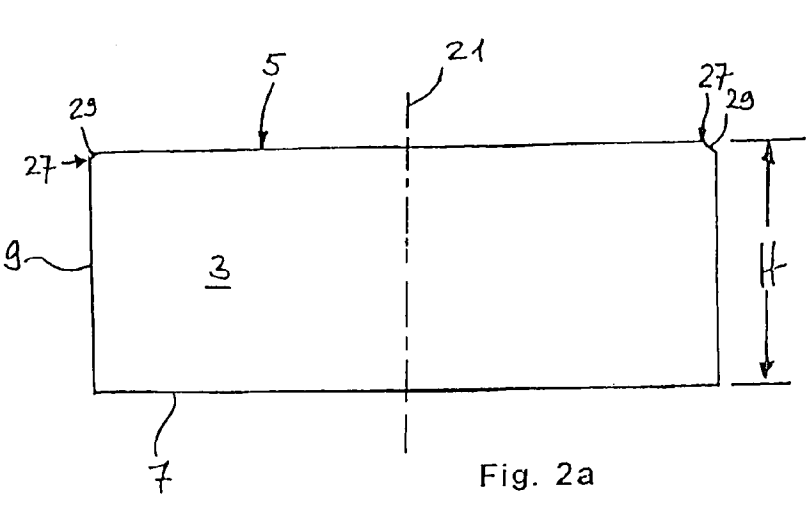
FIG. 2*a*.
Figure 2B:
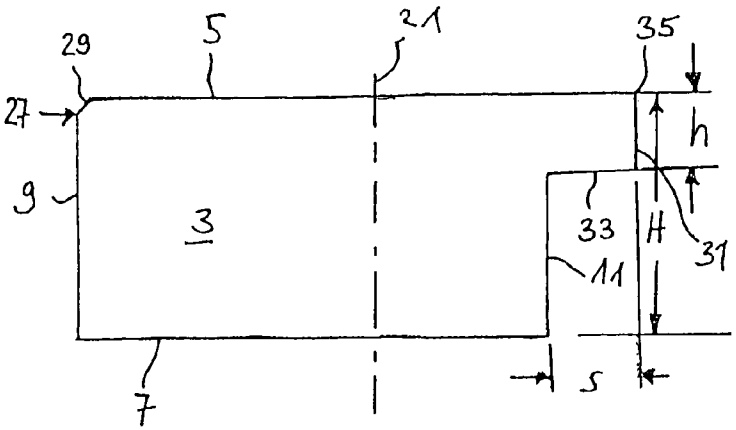
FIG. 2*b*.

In the exemplary embodiments described below, components that are similar in function and structure are designated as far as possible by similar reference numerals. Therefore, to understand the features of the individual components of a specific embodiment the descriptions of other embodiments should be referred to.

Figure 1A:
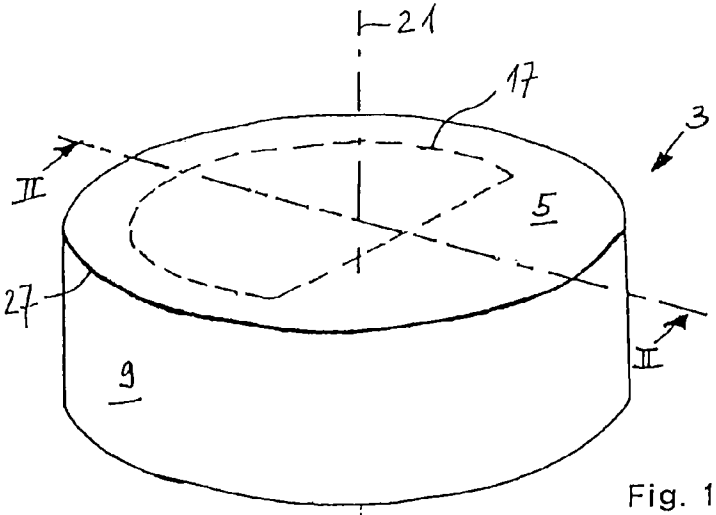
FIG. 1*a*.
Figure 1B:
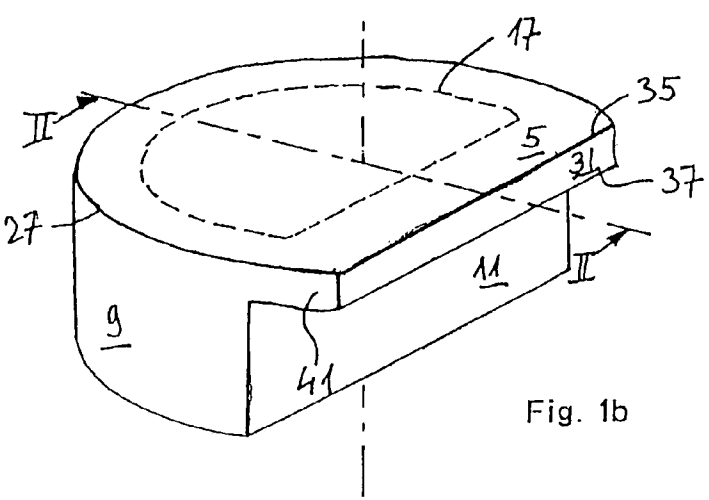
FIG. 1*b*.
Figure 2C:
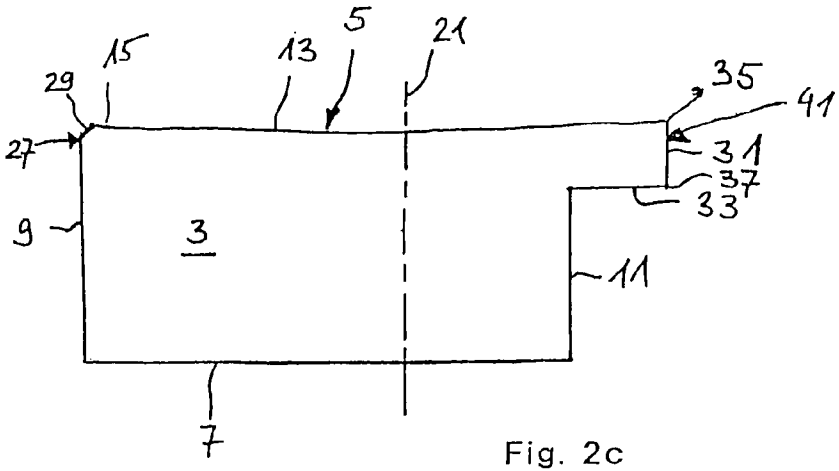
FIG. 2*c*.
Figure 2D:
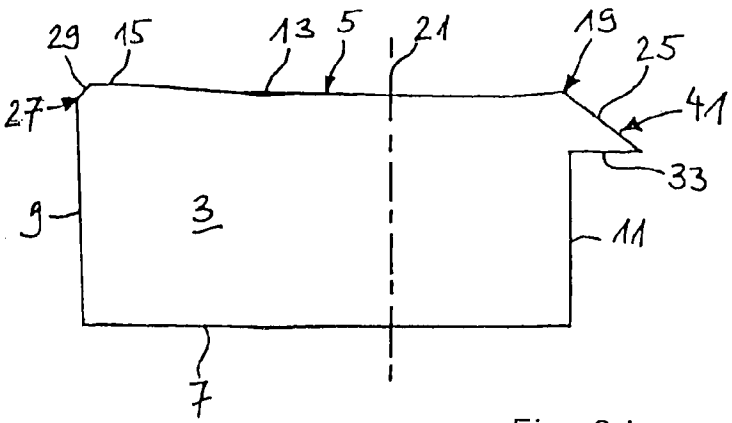
FIG. 2*d*.
Figure 1C:
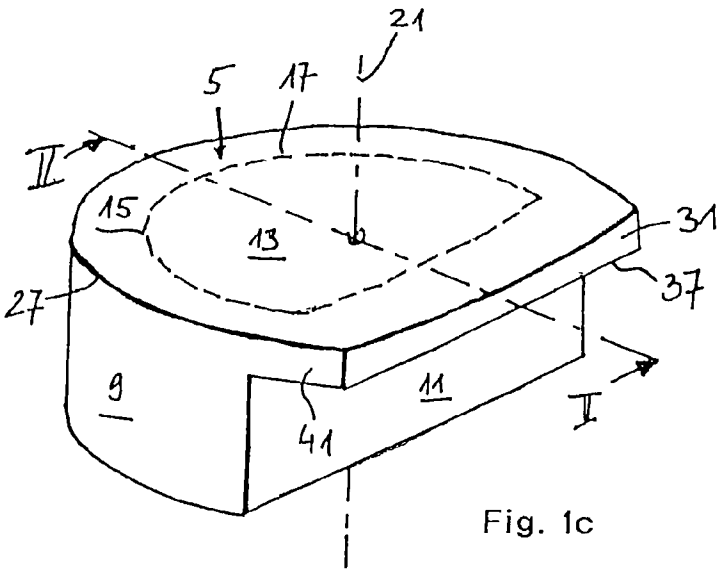
FIG. 1*c*.
Figure 1D:
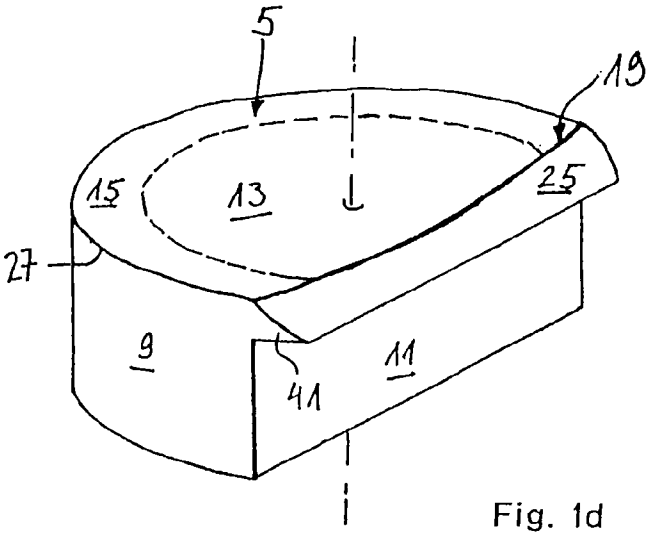
FIG. 1*d*.
Figure 1E:
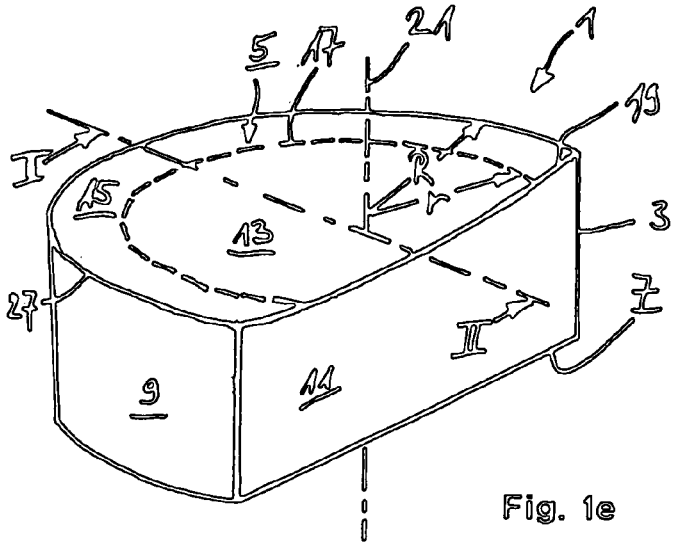
FIG. 1*e* are perspective views of a substrate in successive process steps of manufacturing an optical element according to an embodiment of the invention.
Figure 2E:
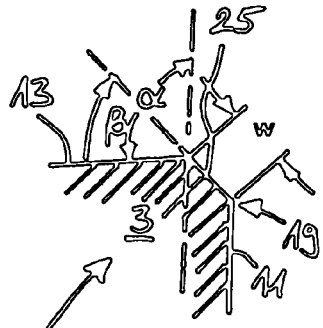
FIG. 2*e* show sections of the substrate corresponding to FIGS. 1*a* to 1*e*, respectively, and along a line II—II shown in FIG. 1*a*.
Figure 2E:
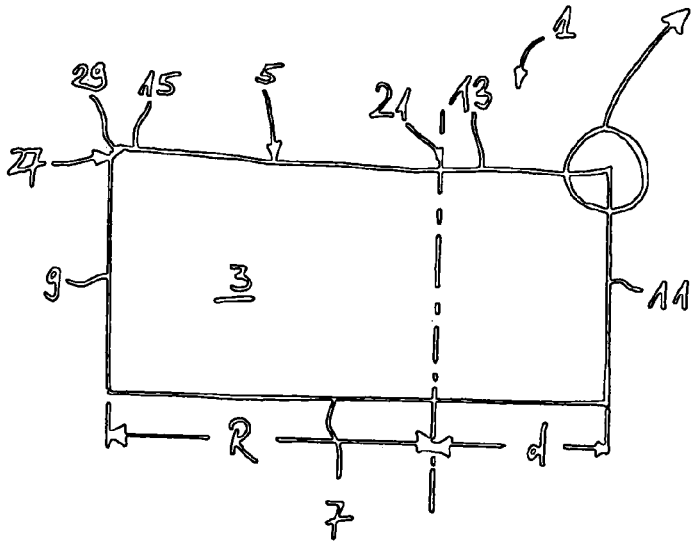

FIGS. 1*a* to 1*e* and 2*a* to 2*e* illustrate a method of manufacture of an optical element 1. The finished optical element 1 is shown in FIGS. 1*e* and 2*e*, wherein FIG. 1*e* is a perspective view and FIG. 2*e* is a section along line II—II shown in FIG. 1*e*.

The finished optical element 1 is a mirror comprising a substrate 3 of a generally cylindrical shape having an upper main surface 5, a lower main surface 7, and peripheral surfaces 9 and 11. The upper main surface 5 consists of an optical mirror surface 13 manufactured such that deviations between a shape of the mirror surface and a target design shape thereof are below predetermined thresholds. The optical surface 13 has an outer periphery or outline 17 formed by a circular line shown in broken lines in FIG. 1, and an edge 19 of the substrate 3.

The optical surface 13 is of an aspherical shape which is rotationally symmetrical with respect to an axis 21. The peripheral surfaces 9 and 11 of the substrate 3 are parallel to axis 21. The radius r of the circular portion of the outline 17 with respect to axis 21 is 100 mm.

The peripheral surface 15 of the main surface 5 is a portion of a ring shape surrounding the circular portion of outline 17 of optical surface 13 and having an outer ring diameter R of 125 mm. The portion of the outline 17 defined by edge 19 of the substrate 3 is a straight line when seen in a direction along axis 21, and has a distance d of 60 mm from axis 21.

As can be seen from the enlarged portion of FIG. 2*e*, the edge 19 of the substrate is formed as a beveled edge having an inclined surface 25 extending under an angle of about 45° with respect to the upper main surface 15 and having a width w of 0.2 mm. Angle $\alpha$ indicated in the enlarged portion of FIG. 2*e* between an extension direction of surface 11 or axis 21 and the upper main surface 15 is about 90°. The width w of the inclined surface is comparatively small such that the optical surface 13 extends very close to the periphery 11 of substrate 3.

An edge 27 between peripheral surface 15 of the upper main surface 5 and the peripheral surface 9 of the substrate 3 has an inclined surface 29 of a greater width of about 2 mm.

The manufacture of the optical element 1 shown in FIG. 1*e* starts from a substrate 3 shown in FIG. 1*a*. The substrate 3 is of a circular cylindrical shape having circular upper and lower main surfaces 5,7 and a peripheral surface 9. A height H of the cylinder is 50 mm. A beveled edge 27 between upper main surface 5 and peripheral surface 9 of the substrate 3 has an inclined surface 29 with a width of 2 mm and is oriented at an angle of 45° with respect to the upper main surface 5.

The substrate 3 is formed of a suitable material, such as glass. Advantageously the material has a low coefficient of thermal expansion which may be less that 10 ppb/K. Examples of such material are glass ceramics which may be obtained under the trade name ZERODUR from SCHOTT, Mainz, Germany, and titanium silicate glasses obtainable under the trade name ULE from Corning, USA.

Broken line 17 shown in FIG. 1*a* indicates the outline of the optical surface 13 (shown in FIG. 1*e*) on the upper main surface 5 of the substrate 3.

Thereafter, a portion of the substrate 3 is removed by a machining, such as grinding, to obtain a shape of the substrate as shown in FIG. 1*b*. The upper main surface 5 has a periphery defined by circular edge 27 and a straight edge 35 between upper surface 5 and a flat peripheral surface 31, extending parallel to axis 21. A distance s between the straight-line portion of the outline 17 and edge 35 corresponds to a difference between radii R and r shown in FIG. 1*e*. Surface 31 has a height h of 4 mm, and a lower edge 37 parallel to upper edge 35. Surface 11 is parallel to surface 31 and arranged at a distance s from surface 31. A surface 33 is formed between edge 37 and surface 11 and extends substantially parallel to upper main surface 5.

A major portion of the substrate which has to be removed for obtaining the substrate shape as shown in FIG. 1*e*, when starting from the substrate shown in FIG. 1*a*, is already removed in the manufacturing step illustrated in FIG. 1*b*. Such removal of major substrate portions will release internal stresses stored in the bulk of the substrate shown in FIG. 1*a*, such that the substrate 3 may deform accordingly. However, a removable membrane portion 41 defined by surfaces 5,31,33 is maintained in the manufacturing step shown in FIG. 1*b*, and will be removed in a later manufacturing step.

A further machining performed on the substrate shown in FIG. 1*b* may include polishing and etching surfaces 31 and 11 to release further internal stress in bulk portions of the substrate arranged close to surfaces 31 and 11.

In a further step the upper main surface 5 is machined to generate a surface shape thereof which closely corresponds to a target shape of the final optical surface 13 in an interior of the outline 17 of the optical surface on the main surface 5. This machining includes milling, grinding, fine grinding by loose abrasive grinding and polishing. The target shape of the optical surface of the exemplary embodiment is a concave or convex spherical or aspherical shape. A result of the machining is determined by measuring the shape of the upper main surface 5 and comparing the measured shape with the target shape of the optical surface. Further machining is then performed based on such comparison. The measurement of the shape of the upper main surface 5 may be performed using contact measuring probes and interferometric methods. Interferometric methods for measuring aspherical surfaces are known from e.g. Chapter 12 of the textbook Optical Shop Testing, $2^{nd}$ Edition, by Daniel Malacara. After such repetitive machining and testing, differences between the target shape of the optical surface and the shape of the main surface in the interior of the outline 17 may be as low as 0.1 nm rms in the low spatial wavelength range.

The main surface is polished using a suitable polishing tool to reduce the deviations in the medium and high spatial wavelength ranges between the shape of the main surface 5 and the target shape of the optical surface. The polishing tool performs a reciprocating movement having a stroke of about 25 mm which is similar to the distance s by which the main surface 5 extends beyond the outline 17 of the optical surface. By providing such peripheral portion of a width s around the complete outline 17 of the optical surface, it is also possible to perform a high quality polishing of the optical surface at its periphery, the outline 17, since the polishing tool is supported by peripheral surface 15 of the main surface such that a same pressure is continuously applied by the polishing tool to the main surface 5.

The height h of the removable membrane portion 41 is chosen such that the substrate provides a sufficient stability to receive the pressure of the polishing tool without significant shape distortions of the main surface caused by bending of the removable membrane portion 41.

During the polishing process, the shape of the main surface 5 is repeatedly measured to determine deviations in the low, medium and high spatial wavelength ranges between the main surface shape and the target shape of the optical surface. The measurements for determining the deviations in the low spatial wavelength range include interferometric methods as mentioned above; the measurements for determining the deviations in the medium spatial wavelength range may also include micro-interferometric methods wherein only selected portions of the main surface are measured at a same time; and measurements for determining the deviations in the high spatial wavelength range may include an atomic force microscope (AFM).

Polishing of the main surface in selected portions thereof may also be used for reducing the deviations in the low spatial wavelength range. After finishing the polishing process, the deviations will be below respective rms thresholds, such as 1 nm, in each of the low, medium and high spatial wavelength ranges. The substrate 3 with the polished main surface 5 is illustrated in FIGS. 1*c* and 2*c*.

After finishing the polishing process, the removal of the removable membrane portion 41 is performed by first forming the inclined surface 25 extending at an angle β of about 45° with respect to the main surface 5 using a machining which may include grinding, as shown in FIGS. 1*d* and 2*d*. Thereafter the remaining trapezoidal portion of the membrane 41 is continuously removed by a machining, such as grinding, to generate a continuously increasing surface extending parallel to surface 11 and finally forming a continuous surface with surface 11 to achieve a configuration as shown in FIGS. 1*e* and 2*e*. In this configuration, the removable membrane portion 41 is completely removed and the inclined surface 25 of beveled edge 19 is reduced to have the width w.

With the method illustrated above, it is possible to obtain a high quality optical surface 13 which extends particularly close to the peripheral surface 11 of substrate 3.

It is possible that the removal of the membrane portion 41 releases further internal stress in the substrate material or that the machining causes deformations of the substrate materials such that the optical surface 13 is deformed in a low or medium spatial wavelength range. Resulting deviations may be reduced by a machining which maintains or will not significantly deteriorate deviations in the mid and high spatial wavelength ranges. Such machining includes magneto-rheological forming (MRF), ion beam figuring (IBF) and fluid jet polishing. An apparatus for MRF is well known in the art and may be obtained from QED technologies, Rochester, N.Y., U.S.A. Such machining may also be used for reducing deviations in the low and medium spatial wavelength range which have not been reduced in the process before removing the removable membrane portion 41 shown in FIGS. 1*c* and 2*c*. Background information relating to ion beam figuring is disclosed in Lynn N. Allen et al., "Demonstration of an ion figuring process", SPIE Vol. 1333 Advanced Optical and Manufacturing and Testing (1990), pages 22 to 33, and background information relating to fluid jet polishing is disclosed in Silvia M. Booij et al., "Jules Verne—a new polishing technique related to FJP", Proceedings of SPIE Vol. 5180 Optical Manufacturing and Testing V, edited by H. Philip Stahl (SPIE, Bellingham, Wash., 2003), pages 89 to 100.

A further method of polishing includes using a polishing tool having a shape substantially conforming to a shape of the optical surface to be manufactured. The polishing tool is maintained in substantially full contact over the whole surface of the optical element while performing reciprocating or circulating movements of the polishing tool relative to the optical surface.

The polishing may also include a hand-polishing in which a suitable tool, such as a suitable fabric is moved by hand across the surface to be polished. Background information relating to high quality polishing is disclosed in Norman J. Brown, "PREPARATION OF ULTRASMOOTH SURFACES", Ann. Rev. Mater. Sci. 1986.16: 371–88.

Thereafter the optical surface 13 on the optical element 3 shown in FIGS. 1*e* and 2*e* corresponds to its target shape, i.e. deviations between the shape of the optical surface 13 and its target shape are below the predefined thresholds in the low, medium and high spatial wavelength ranges. Thereafter a reflective coating is applied to the optical surface by suitable methods well know in the art, such as sputtering. The reflective coating may comprise plural layers, such as 100 layers of alternating dielectric materials, such as molybdenum and silicon for use in an EUV lithography application.

Figure 3A:
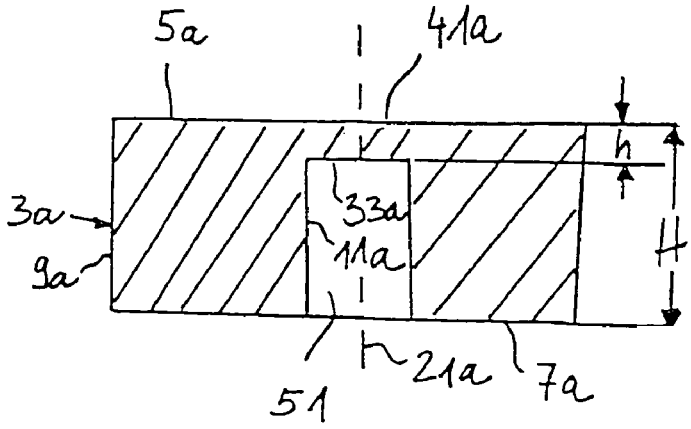
FIG. 3*a*, FIG. 3*b*, FIG. 3*c*, and FIG. 3*d* show sectional views of a substrate in successive process steps of manufacturing an optical element according to a second embodiment of the invention.
Figure 3B:
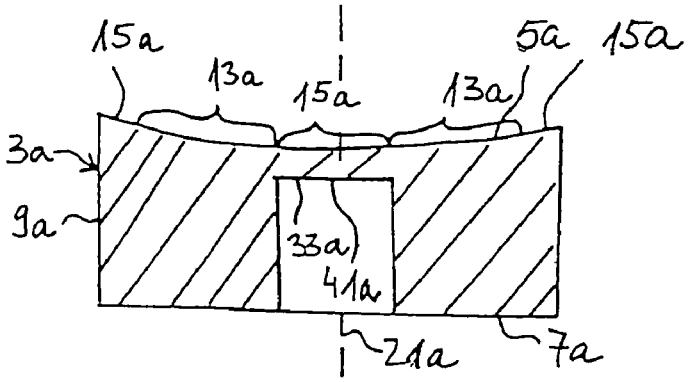
Figure 3C:
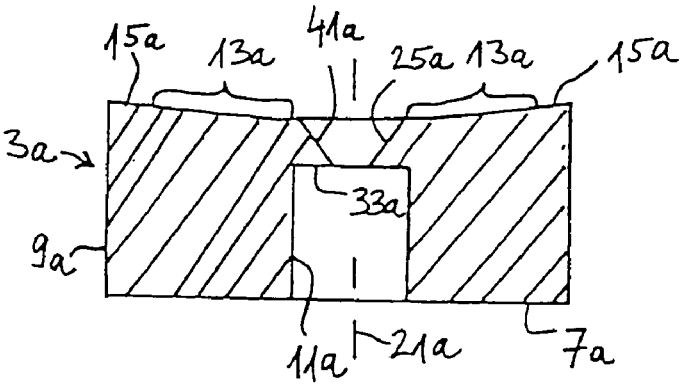
Figure 3D:
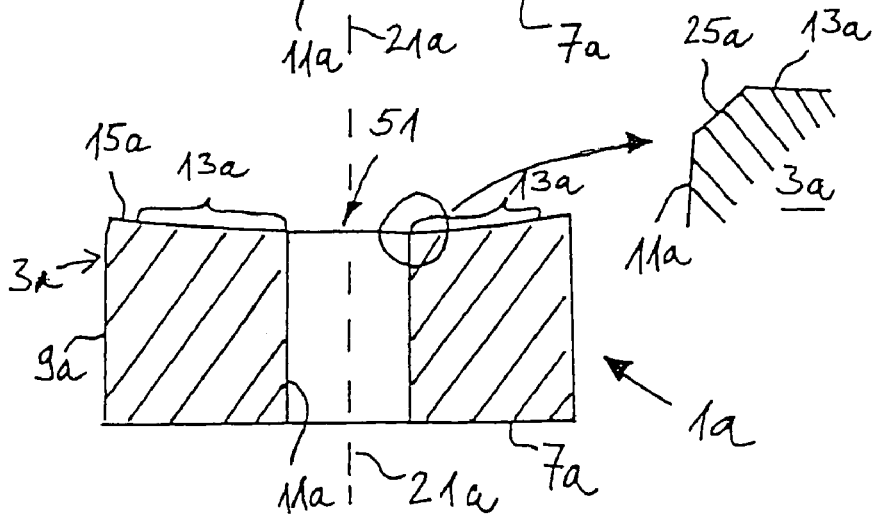

FIGS. 3*a* to 3*d* illustrate a method of manufacture of a further optical element 1*a*. FIG. 3*d* shows a cross-section of the manufactured optical element 1*a* which is an optical mirror having a ring shaped aspherical mirror surface 13*a*, wherein a central hole 51 is formed in a substrate 3*a* on which the mirror surface 13*a* is formed. The mirror surface 13*a* extends close to a peripheral surface 11*a* defining the hole 51 in the substrate 3*a*. The outer periphery of the mirror surface 13*a* is provided at a distance from the outer peripheral surface 9*a* since a ring shaped peripheral surface 15*a* is provided on the upper main surface 5*a* of the substrate 3*a*.

The manufacture of the mirror element 1*a* is, apart from the different geometries of the mirror elements, similar to the manufacture of the mirror element illustrated with reference to FIGS. 1 and 2 above. Corresponding details of the manufacturing process are therefore not repeated in the following description of the manufacture illustrated in FIGS. 3*a* to 3*d*.

The manufacture starts from a substrate having a cross-section as shown in FIG. 3*a*. The substrate is rotationally symmetric with respect to axis 21. An upper surface 5*a* of the substrate is a continuous surface, and a blind hole 51 having a cylindrical peripheral surface 11*a* and a bottom surface 33*a* is formed in the substrate 3*a* from a bottom surface 7*a* thereof. A remaining portion 41*a* of the substrate between surfaces 5*a* and 33*a* has a height h of about 4 mm, which is significantly lower than a total height H of about 20 mm of the substrate 3*a*. A diameter of the substrate is about 100 mm, and a diameter of hole 51 is about 15 mm.

Thereafter, a machining including grinding and polishing is performed to generate a ring shaped optical surface 13*a* which forms a portion of upper surface 5*a* of the substrate. The ring shaped optical surface 13*a* corresponds to a target shape of the optical surface in that deviations between the shape of the optical surface 13*a* and its target shape are below predefined thresholds in the low, medium and high spatial wavelength ranges. Remaining portions 15*a* of the upper surface 5*a* not covered by the optical surface 13*a* comprise a circular central portion 15*a* and an outer ring shaped portion 15*a*. These remaining portions are provided for supporting a polishing tool in a polishing step of the manufacture of the optical surface 13*a*, as shown in FIG. 3*b*.

Thereafter, the removable portion 41*a* is removed by first forming a conical inclined surface 25*a* by a machining such as grinding, and then removing a remaining portion which is triangular and limited by surfaces 25*a* and 33*a* in FIG. 3*c* to form a continuous inner peripheral surface 11*a* of hole 51 as shown in FIG. 3*d*.

Thereafter, remaining deviations between the shape of the optical surface 13*a* and its target shape are reduced by a machining such as ion beam figuring, and alternating dielectric material layers are applied to the optical surface 13*a* as a reflective coating.

In the examples illustrated above, the peripheral surfaces of the substrate extend parallel to the axis of symmetry of the optical surface. It is, however, possible that the periphery extends under an oblique angle with respect to such axis of symmetry or at an angle which significantly differs from 90° with respect to the optical surface.

In the examples illustrated above, the optical surface is rotationally symmetric with respect to an axis traversing the substrate, but it is also possible that the optical surface has an out of axis configuration with an axis of rotation disposed outside of the substrate. Further, it is also possible that the optical surface has a shape which is not rotationally symmetric.

Summarized, a method of manufacturing an optical element having an optical surface extending close to a periphery of a substrate comprises: providing a substrate having a main surface extending beyond a periphery of the optical surface and also performing a polishing of the optical surface in regions of the main surface extending beyond the optical surface. Thereafter, material of the substrate carrying a portion of the surface extending beyond the optical surface is removed.

While the invention has been described also with respect to certain specific embodiments thereof, it is evident that many alternatives, modifications and variations will be apparent to those skilled in the art. Accordingly, the exemplary embodiments of the invention set forth herein are intended to be illustrative and not limiting in any way. Various changes may be made without departing from the spirit and scope of the present invention as defined in the following claims.

The invention claimed is:

1. A method of manufacturing an optical element having an optical surface of a predetermined shape, the method comprising:

machining a substrate having a main surface extending beyond an outline of an optical surface of the main surface, such that the substrate has a first thickness in a height direction transverse to the main surface and within a complete interior of the outline of the optical surface, and such that the substrate has a second thickness in the height direction and within a removable portion of the main surface disposed outside of the outline of the optical surface, wherein a ratio of the first thickness over the second thickness is greater than 3;

performing a first processing of the main surface such that differences between a shape of the main surface and the predetermined shape are below a predetermined first tolerance within the interior of the outline of the optical surface;

performing a second processing of the main surface, wherein the second processing includes polishing the main surface such that the differences between the shape of the main surface and the predetermined shape are below a predetermined second tolerance of 1 nm rms at a spatial wavelength in a spatial wavelength range from about 100 nm to about 1 mm and within the interior of the outline of the optical surface; and performing a third processing of the substrate including removing the removable portion of the substrate to reduce a distance between a periphery of the optical surface and a periphery of the main surface of the substrate.

2. The method according to claim 1, further comprising:

performing a fourth processing of the main surface such that the differences between the shape of the main surface and the predetermined shape are below a predetermined third tolerance of 1 nm rms at a spatial wavelength in a spatial wavelength range from about 1 mm to about a diameter of the optical surface and within the interior of the outline of the optical surface.

3. The method according to claim 2, wherein the fourth processing includes at least one of ion beam figuring and magneto-rheological finishing.

4. The method according to claim 1, wherein the third processing comprises:

forming a beveled edge adjacent to the outline of the optical surface, the beveled edge comprising an inclined surface extending under a bevel angle with respect to the main surface, wherein the bevel angle is less than an angle between the main surface and the height direction; and thereafter removing substrate material to reduce a width of the inclined surface.

5. The method according to claim 4, wherein the bevel angle is in a region of about 35° to about 55°.

6. The method according to claim 4, wherein the removing of the substrate material is performed such that a lateral surface of the substrate adjacent to the inclined surface opposite to the main surface extends in the height direction.

7. The method according to claim 4, wherein the width of the inclined surface is reduced to less than 0.4 mm.

8. The method according to claim 1, wherein the third processing comprises:

at least one of etching and polishing of a lateral surface of the substrate generated by removing the removable portion.

9. The method according to claim 1, wherein the first processing includes measuring the shape of the main surface; and removing portions of the main surface based on a difference between the measured shape and the predetermined shape.

10. The method according to claim 9, wherein the measuring includes performing an interferometric measurement of substantially the complete interior of the outline of the optical surface with a single measuring beam.

11. The method according to claim 1, wherein the second processing includes measuring the shape of the main surface using at least one of an interferometric measurement of a portion of the interior of the outline of the optical surface with a measuring beam spot having a diameter less than 5 mm, and an atomic force microscope.

12. The method according to claim 1, wherein the first processing includes at least one of milling, grinding, loose abrasive grinding, and polishing.

13. The method according to claim 1, wherein the fourth processing includes measuring the shape of the main surface; and removing portions of the main surface based on a difference between the measured shape and the predetermined shape.

14. The method according to claim 13, wherein the measuring includes performing an interferometric measurement of substantially the complete interior of the outline of the optical surface with a single measuring beam.

15. The method according to claim 1, wherein the predetermined shape is an aspherical shape.

16. The method according to claim 1, wherein the second thickness is less than 5 mm.

17. The method according to claim 1, further comprising:

finishing of the optical surface.

18. The method according to claim 17, wherein the finishing comprises applying a coating to the optical surface.

19. The method according to claim 18, wherein the coating comprises at least one of a reflective coating, an anti-reflective coating and a protective coating.

* * * * *